US007469889B2

(12) United States Patent
Kamijoh

(10) Patent No.: US 7,469,889 B2
(45) Date of Patent: Dec. 30, 2008

(54) SHEET FEEDING APPARATUS AND IMAGE FORMING APPARATUS

(75) Inventor: Masahiko Kamijoh, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 10/611,901

(22) Filed: Jul. 3, 2003

(65) Prior Publication Data

US 2004/0065993 A1 Apr. 8, 2004

(30) Foreign Application Priority Data

Oct. 4, 2002 (JP) ..... 2002-291810

(51) Int. Cl.
*B65H 3/52* (2006.01)

(52) U.S. Cl. ..... 271/121

(58) Field of Classification Search ..... 271/121, 271/104, 137, 167

See application file for complete search history.

(56) References Cited

U.S. PATENT DOCUMENTS

| | | | | |
|---|---|---|---|---|
| 4,150,181 | A * | 4/1979 | Smith | 427/444 |
| 5,802,434 | A * | 9/1998 | Takehara et al. | 399/323 |
| 5,997,965 | A * | 12/1999 | Shimazu et al. | 428/1.32 |
| 6,059,483 | A * | 5/2000 | Owens et al. | 403/267 |
| 6,280,055 | B1 * | 8/2001 | Merko | 362/235 |
| 6,339,484 | B1 * | 1/2002 | Arai | 358/498 |
| 6,688,590 | B2 * | 2/2004 | Billings et al. | 271/9.05 |
| 6,824,131 | B2 * | 11/2004 | Togashi | 271/121 |
| 2002/0036377 | A1 * | 3/2002 | Togashi | 271/127 |

FOREIGN PATENT DOCUMENTS

| | | | |
|---|---|---|---|
| EP | 1 179 498 | B1 | 10/2006 |
| JP | 2-55634 | | 4/1990 |
| JP | 6-67480 | | 3/1994 |
| JP | 8-234531 | | 9/1996 |
| JP | 10-139197 | | 5/1998 |
| JP | 11-24507 | | 1/1999 |
| JP | 2002-68511 | * | 3/2002 |
| JP | 2002-131091 | | 5/2002 |

OTHER PUBLICATIONS

Sachio Yasufuku, Application of Engineering Plastic Materials to Office Automation and Audio-Visual Appliances in Japan, Nov./Dec. 1992, IEEE Electrical Insulation Magazine, vol. 8, No. 6, pp. 5-12.*

(Continued)

*Primary Examiner*—Patrick H Mackey
*Assistant Examiner*—Thomas A Morrison
(74) *Attorney, Agent, or Firm*—Oblon, Spivak, McClelland, Maier & Neustadt, P.C.

(57) ABSTRACT

An image forming apparatus including a sheet feed apparatus configured to sequentially separate sheets stacked on a sheet stacking member. The sheet feed apparatus includes a sheet feed roller configured to come in pressing contact with the uppermost sheet in order to feed the sheet. The sheet feed apparatus also includes a tilt member arranged to oppose the sheet feed roller. The sheet feed apparatus includes a contact face arranged to press against the sheet feed roller. The sheet feed apparatus also includes a tilt face arranged to contact an edge of the uppermost sheet. The tilt face and the contact face are formed from one of polybutylene terephthalate (PBT), polyethylene (PE), metal, poly-ether-ether-ketone (PEEK), and polyimide (PI) to provide superior wear resistance.

16 Claims, 9 Drawing Sheets

OTHER PUBLICATIONS

Printout of website http://www.polymerplastics.com/performance_vespel.shtml, Aug. 16, 2000.*

Printout of website http://www.craftechind.com/material.htm, Jan. 20, 1998.*

Printout of website http://www.tplast.ee/plast10en.php, Aug. 27, 2002.*

Sangeeta Hambir et al., Sintering of ultra high molecular weight polyethylene, Jun. 2000, Bull. Mater. Sci., vol. 23, No. 3, pp. 221-226, © Indian Academy of Sciences.*

Printout of website http://www.sdplastics.com/polyeth.html, Jan. 21, 1997.*

* cited by examiner

SHEET FEEDING APPARATUS AND IMAGE FORMING APPARATUS

CROSS-REFERENCE TO RELATED APPLICATIONS

The present document claims priority to Japanese Patent Application No. 2002-291810 filed in the Japanese Patent Office on Oct. 4, 2001, the entire contents of which are hereby incorporated by reference.

BACKGROUND OF THE INVENTION

1. Field of the Invention

The present invention relates to a sheet feed apparatus and an image forming apparatus such as a copying machine, a facsimile machine, a printer, or other similar image forming apparatus.

2. Discussion of the Background

Japanese Patent Laid-Open No. 10-139197 bulletin discloses a sheet feed apparatus that can separate one sheet of a plurality of stacking sheets by contacting each sheet with a tilt face of a tilt member. The sheet feed apparatus includes a separation means. The separation means includes a separation guide as the tilt member, and a high friction member. A coefficient of friction between the high friction member and the sheet is bigger than both a coefficient of friction between the sheet and the separation guide and a coefficient of friction between the sheet and the next sheet in the plurality of sheets. Therefore, one sheet can be conveyed by the separation means from stacking sheets.

In conventional systems, a sheet feed apparatus includes a feed roller contacting a tilt member with a separation means. However, in the conventional sheet feed apparatus there is problem in that the surface of the tilt member is easily worn or otherwise damaged when receiving a load by friction caused through contact with the feed roller. Once worn, the sheets are not consistently fed from the sheet feed apparatus, leading to missed pages, jammed pages, or other operational deficiencies. What is desirable, as discovered by the present inventors, is a sheet feed apparatus where the surface of the tilt member is not easily damaged from the friction associated with feeding sheets.

SUMMARY OF THE INVENTION

An image forming apparatus configured to form an image on a sheet fed from a sheet feeder. The image forming apparatus includes a sheet feed apparatus configured to separate sheets stacked on a sheet stacking member. The sheet feeding apparatus includes a sheet feed roller arranged to come in contact with the uppermost sheet in the sheet stacking member, and a tilt member arranged to oppose the sheet feed roller. The tilt member includes a contact face configured to press against the sheet feed roller, and a tilt face arranged to make contact with an edge of the uppermost sheet. The tilt face and the contact face are formed from at least one of polybutylene perephthalate (PBT), polyethylene (PE), metal, poly-ether-ether-ketone (PEEK), and polyimide (PI).

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

Embodiments of the present invention are described in detail with reference to the drawings, wherein like reference numerals designate identical or corresponding parts throughout the several views.

DETAILED DESCRIPTION OF THE INVENTION

Figure 1:
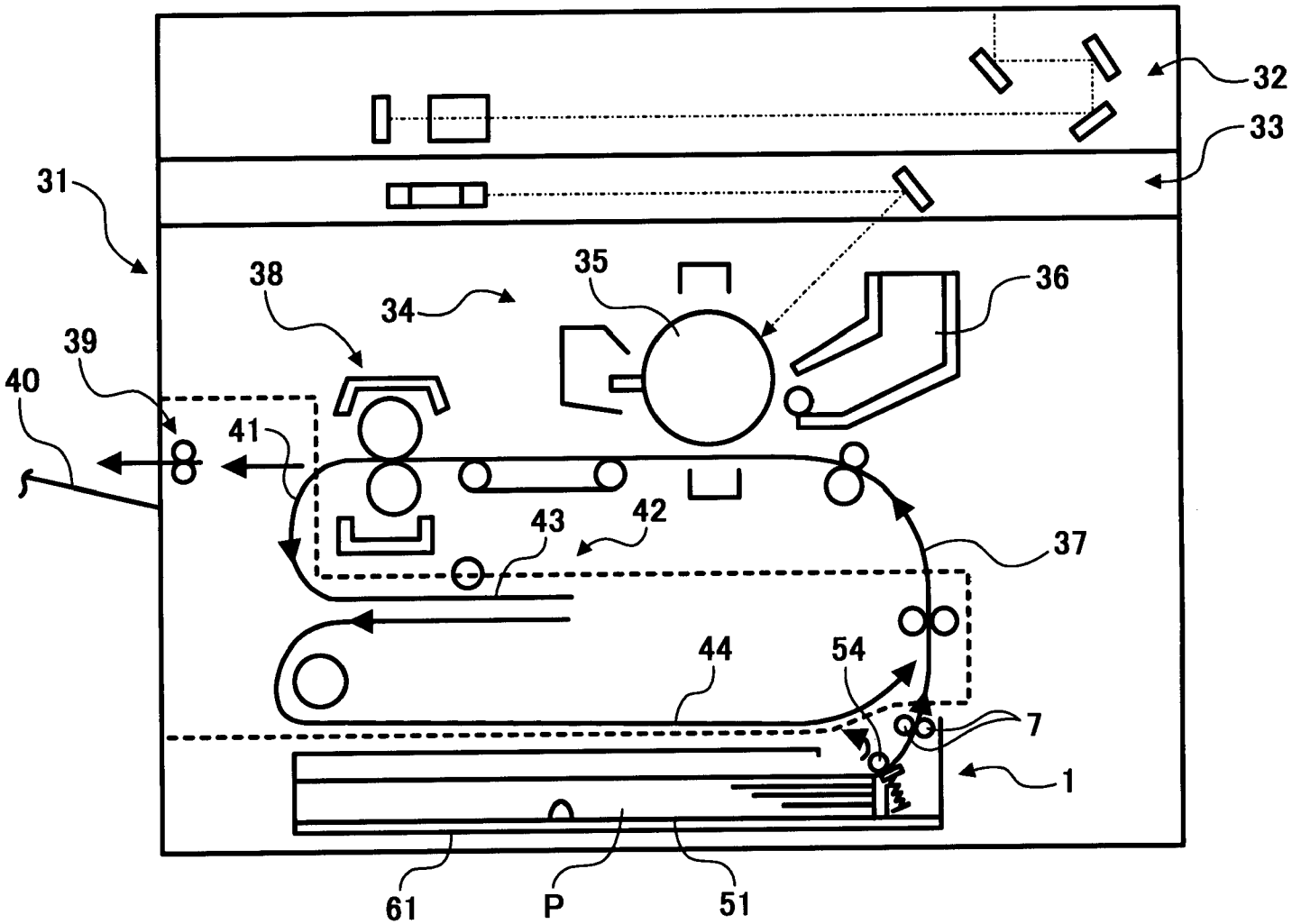
FIG. 1 is a diagram of an image forming apparatus including a sheet feed apparatus.

FIG. 1 is an image forming apparatus of the first embodiment. In this embodiment, a latent image is formed on a photo conductor 35 of an image forming part 34 by a writing device 33 based on an image data read by a reading device 32 above a main body 31. A toner goes onto the latent image from a developing device 36, and then a visible image is formed.

Below the main body 31, a sheet feed apparatus 1 is disposed. A sheet feed roller 54 and conveying rollers 7 convey a sheet P through a passage 37 to the photo conductor 35, and then the visible image transfers the sheet P.

The sheet P goes toward a fixing device 38, and then the fixing device 38 fixes the visible image on the sheet P. Further, output rollers 39 output the sheet P to an output storing tray 40. On the other hand, in the duplex mode, the sheet P passes a passage 41 to a duplex tray 43 of a duplex device 42, and then the paper S is switched back. The paper S passes a passage 44 to the image forming part 34 and the fixing device 38, and then the image is formed on the other side of the sheet S.

Figure 2:
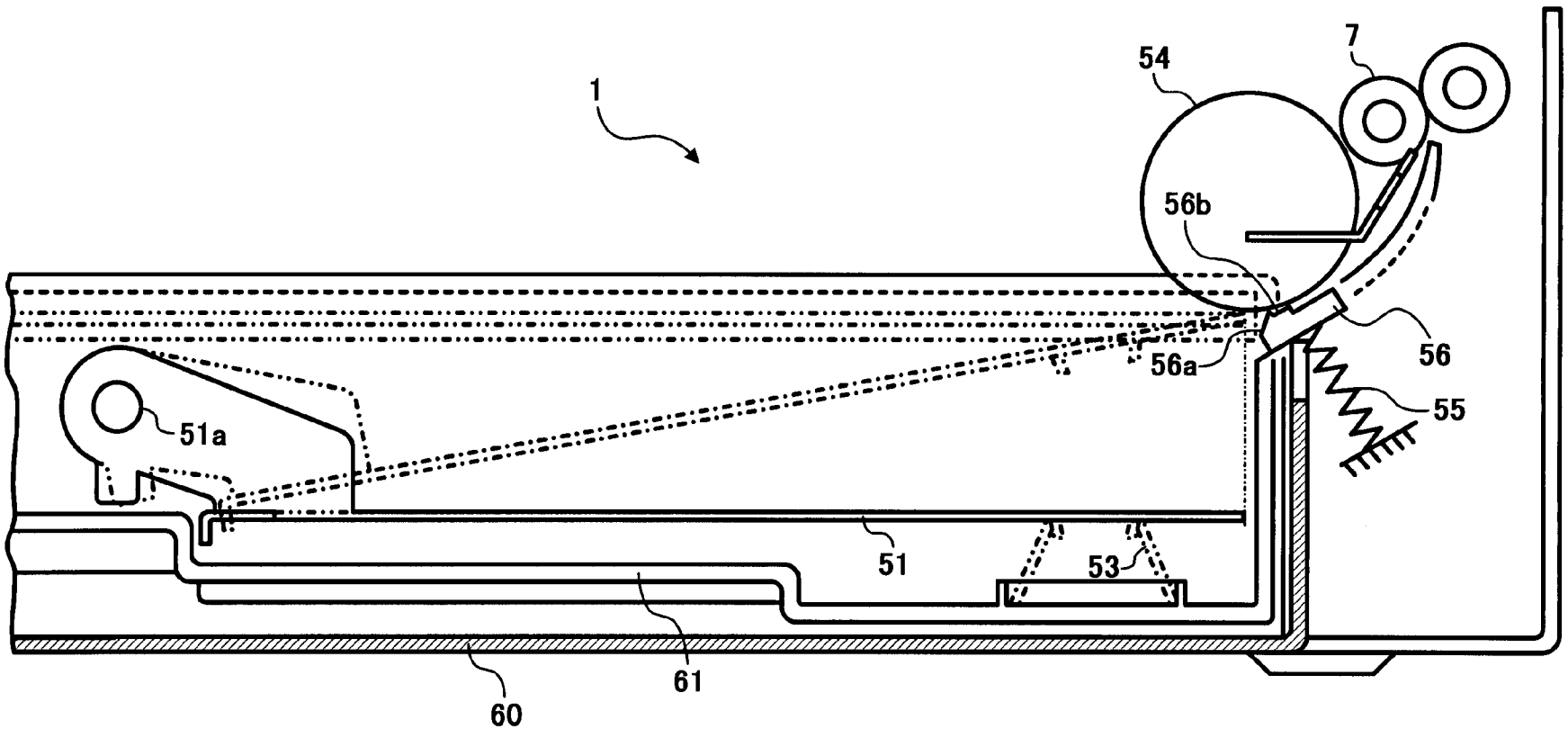
FIG. 2 is a diagram of the sheet feed apparatus of FIG. 1.

As shown in FIG. 2, the sheet feed apparatus 1 includes a bottom board 51 stacking sheets as a sheet stacking member, a sheet feed roller 54 feeding the sheet on the bottom board 51, a tilt member 56 having a tilt face 56*a* arranged to touch the edge of the sheet. The sheets are separated in the tilt face 56*a*.

In this embodiment, the whole tilt member 56 is formed from polybutylene terephthalate (PBT) or polyethylene (PE). It is possible that only the tilt face 56*a* and a contact face 56*b* contacting the sheet feed roller 54 may be formed from PBT or PE.

Figure 3:
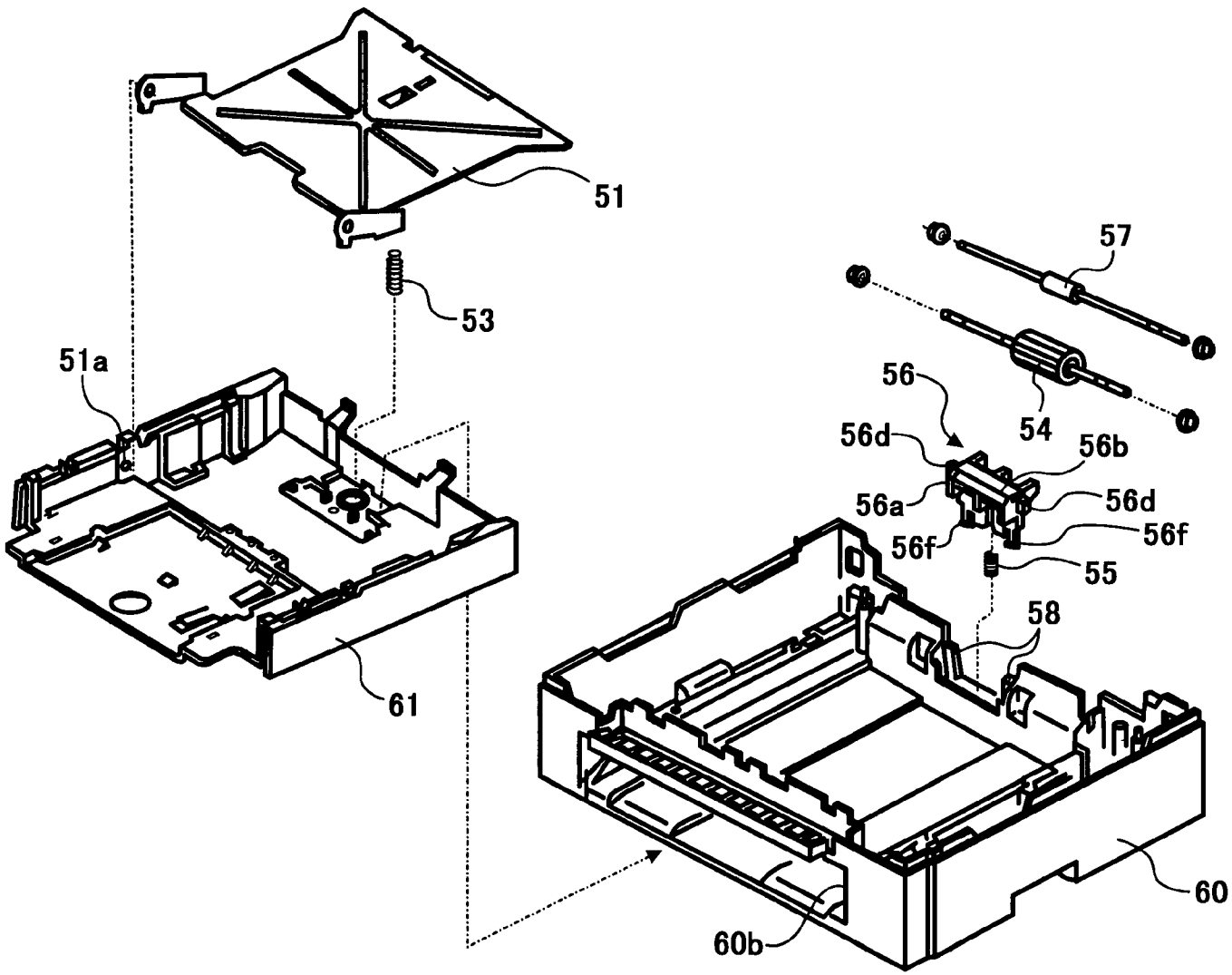
FIG. 3 is a diagram showing the internal construction of the sheet feed apparatus of FIG. 2.

As shown in FIG. 3, sheets are received on the bottom board 51 in a sheet feed cassette 61. The sheet feed cassette 61 is held in a main body 60 of the sheet feed apparatus 1 through a hole 60*b*. The bottom board 51 is supported by a compression spring 53 and rotates in the axis 51*a* in the counterclockwise direction as shown in FIG. 2. The sheet feed roller 54 contacts the contact face 56*a* pressed by a compression spring 55.

Figure 4:
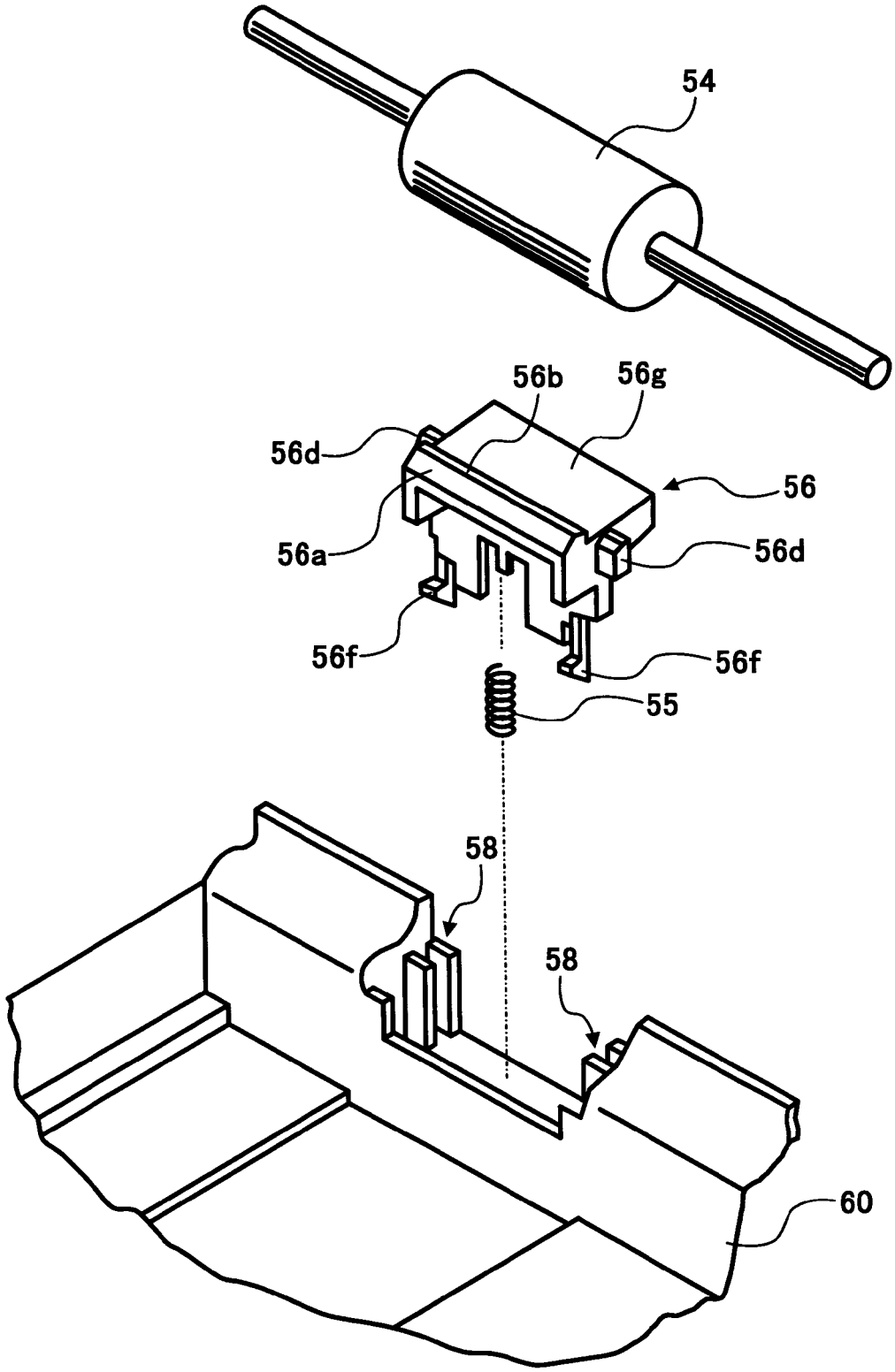
FIG. 4 is a diagram showing an enlarged view of FIG. 3.

As shown in FIG. 4, the tilt member 56 of the first embodiment includes two ribs 56*d* in order to be guided by guiding rails 58 formed in the main body 60. Therefore, the tilt member 56 can move toward the sheet feed roller 54 straightly. Further, the tilt member 56 includes two hooks 56*f* for limiting the range of the movement.

Figure 5:
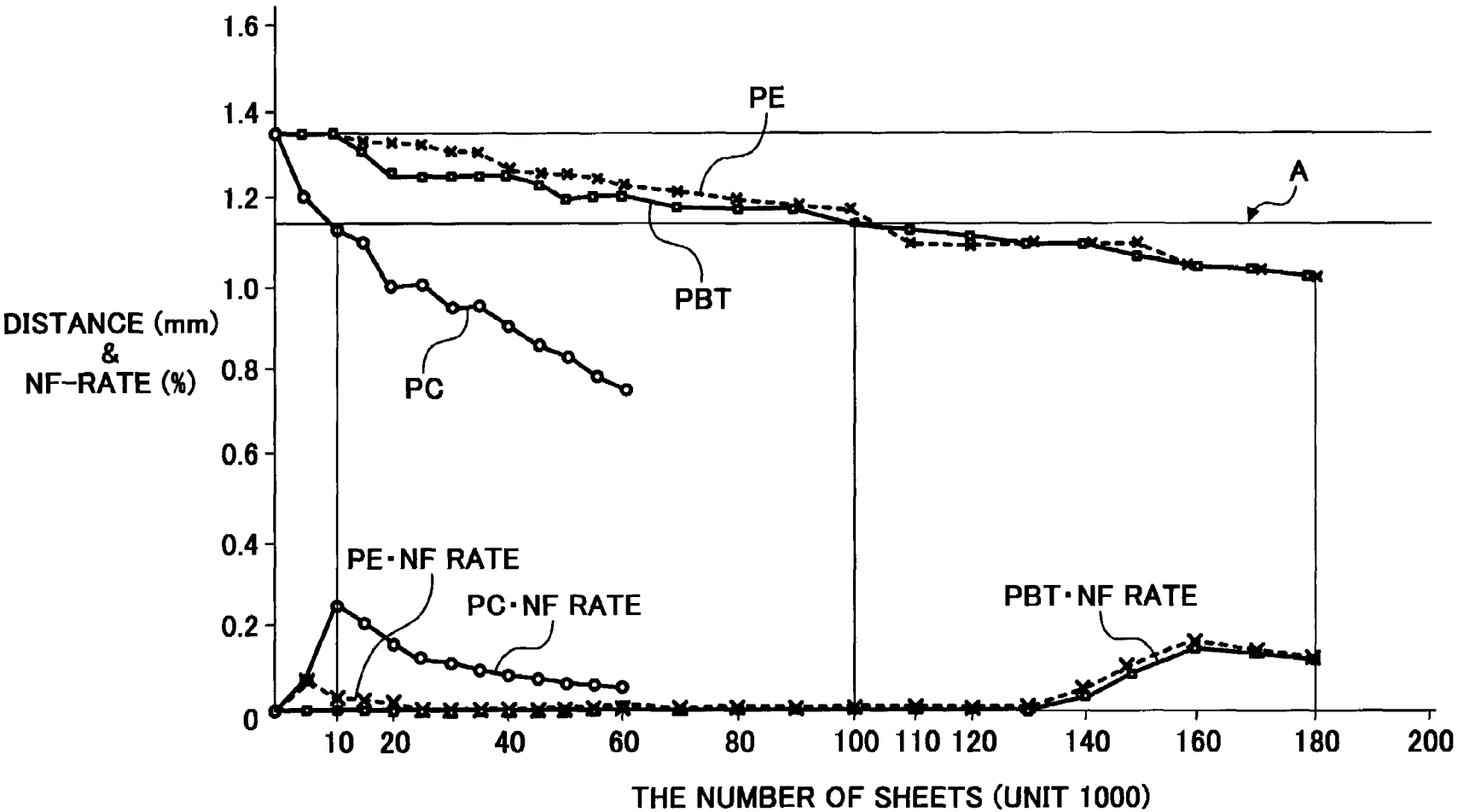
FIG. 5 is a chart of experiment results when different materials are used in the sheet feed apparatus of FIG. 2.

FIG. 5 is a chart of experimental results of different materials used in the sheet feed apparatus of FIG. 2. Experiment conditions were as follows:

Materials of the tilt member—polycarbonate (PC), polybutylene terephthalate (PBT), polyethylene (PE)

A pressing force of the tilt member pushing the sheet feed roller—2.99N

Speed when the sheet feed roller is separating sheets—133.5 mm/sec

Speed after the sheet feed roller is separating the sheets—66.75 mm/sec

A pressing force when the sheet feed roller is feeding sheet—Minimum 3.90N, Max 5.90N An angle of the tilt side to the sheet—60°

Timing of measuring a wear of the tilt side—0-60000 sheets; every 5000 sheets; 60000-180,000 sheets; 10,000 sheets Kind of paper—LT size Interval of experiment—5000 sheets per day Distance between the contact face 56*a* and a plane face 56*g*—1.36 mm In FIG. 5, the line A (1.16 mm) is designated as a non-feed line. The non-feed line is determined empirically as the point where significant non-feeds occur if the material is formed from PC. This line corresponds to 0.2 mm wear from an initial thickness of material.

The experiment showed that a tilt member formed from PE or PBT demonstrated superior wear resistance because tilt members made of these materials did not fall bellow the non-feed line L until about 110,000 sheets have been printed. In contrast, a tilt member formed from PC did not demonstrate good wear resistance as the tilt member fell below the non-feed line when about 10,000 sheets were printed. Therefore, experimental results showed that superior performance is achieved if at least the tilt face 56*a* and the contact face 56*b* are formed from PE or PBT. Further analysis showed that the entire tilt member 56 may be formed from either PE or PBT will reduce manufacturing costs.

Figure 6:
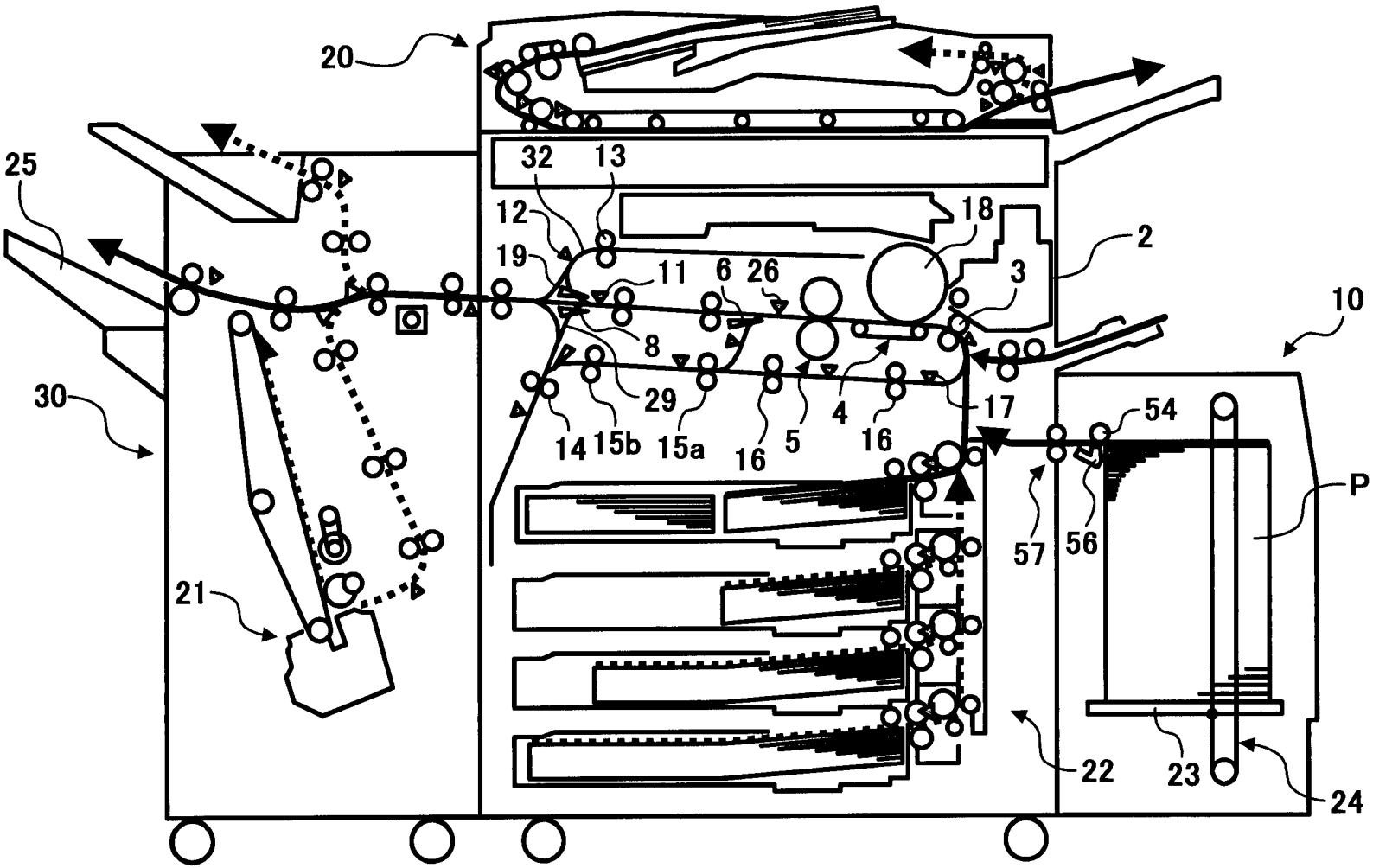
FIG. 6 is a diagram of an image forming apparatus including a large paper feed apparatus.

FIG. 6 is a diagram of a second embodiment of an image forming apparatus. The image forming apparatus of the second embodiment includes a large sheet feed apparatus 10 in the right side lower part. The large sheet feed apparatus 10 includes a loading board 23 configured to stack a large number of sheets, a tilt member 56 having a tilt face and a contact face, a sheet feed roller 54 feeding a sheet on the stacking board 23. The sheets are separated in the tilt face of the tilt member 56.

The image forming apparatus also includes a main body 2, an automatic document feeder (ADF) 20, and a finisher 30 having a stapler device 21. In the lower part of the main body 2, a paper feed apparatus 22 including plural sheet feed cassettes is disposed.

When an image is formed on a one side of a sheet, a sheet is fed from the large sheet feed apparatus 10 or a sheet feed cassette of a sheet feed apparatus 22. The sheet is conveyed by rollers, and then the sheet reaches a registration roller 3. Then, an image on a photo conductor 18 is transferred to the sheet by a transfer belt 4, and then a fixing device 5 fixes the image on the sheet.

In one simplex mode of operations (i.e., single-sided copying), the image side of the sheet is input face-up. In this mode of operations, the sheet is conveyed to the left shown in the FIG. 6. An entrance sensor 11 detects the image side of the sheet, and an upper divergence nail 19 and a lower divergence nail 8 are not engaged. Then, the sheet is output to the output tray 25 through the finisher 30.

In another simplex mode of operations, the image side of the sheet is input facedown. In this mode of operations, the upper divergence nail 19 and the lower divergence nail 8 each rotate so that the sheet is led to an upper turning-over path 32 or a lower turning-over path 29. In this mode of operation, either the upper divergence nail 19 or the lower divergence nail 8 may move first. However, the upper divergence nail 19 and the lower divergence nail 8 may move alternately to prevent the sheets from interfering with each other.

If the upper divergence nail 19 moves first, the sheet is sent to the upper turning-over path 32. Then, a switchback roller 13 conveys the sheet. When a turning-over sensor 12 detects an end of the sheet, the switchback roller 13 turns in reverse. Then, the sheet returns to a divergence position and then the sheet is output to the output tray 25 through the finisher 30.

When a second sheet is conveyed immediately behind the first sheet, the lower divergence nail 8 moves. Then, the sheet is sent to the lower turning-over path 29. Then, the second sheet returns to a divergence position again and the second sheet is output to the output tray 25 through the finisher 30. In this way, even if sheets are conveyed continually, the sheets do not interfere with each other.

Figure 7:
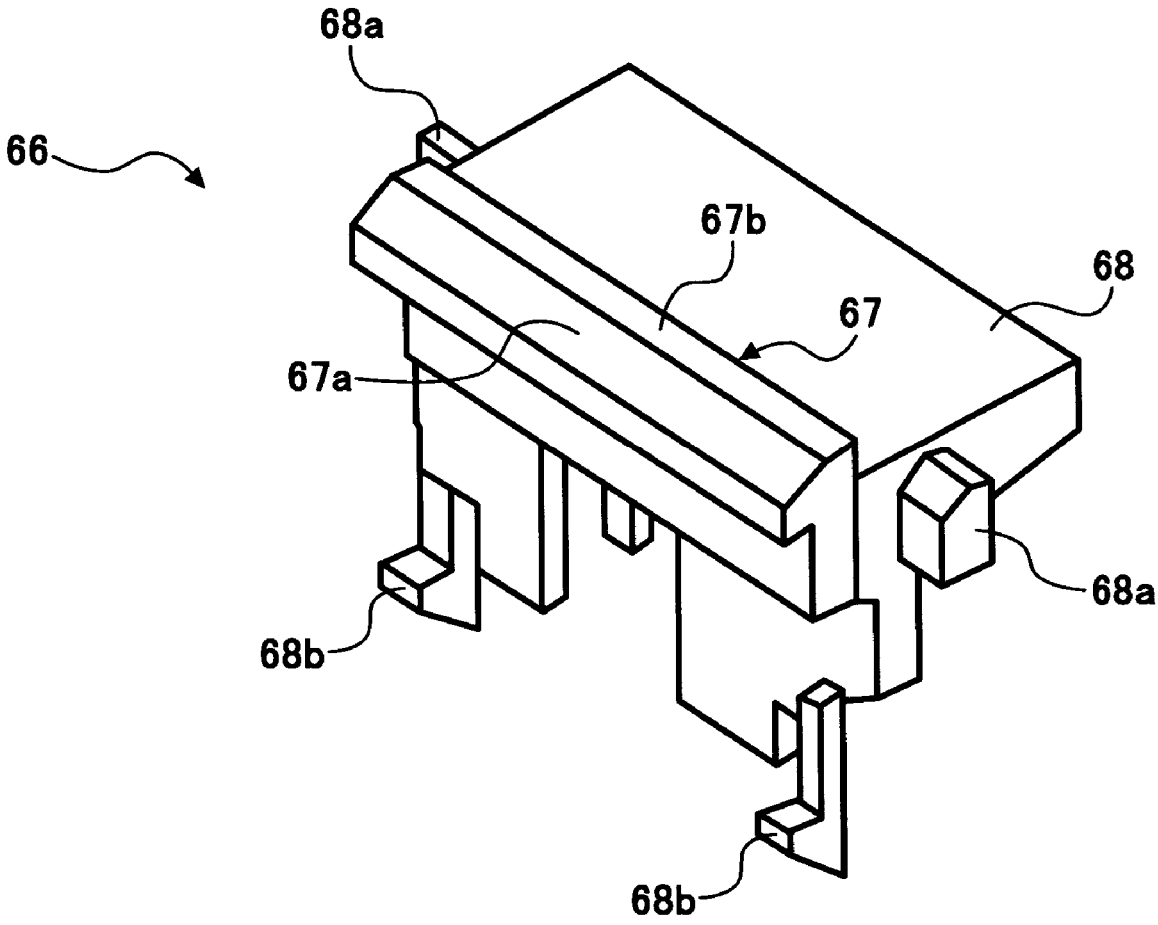
FIG. 7 is a diagram a tilt member of the large paper feed apparatus of FIG. 6.
Figure 8:
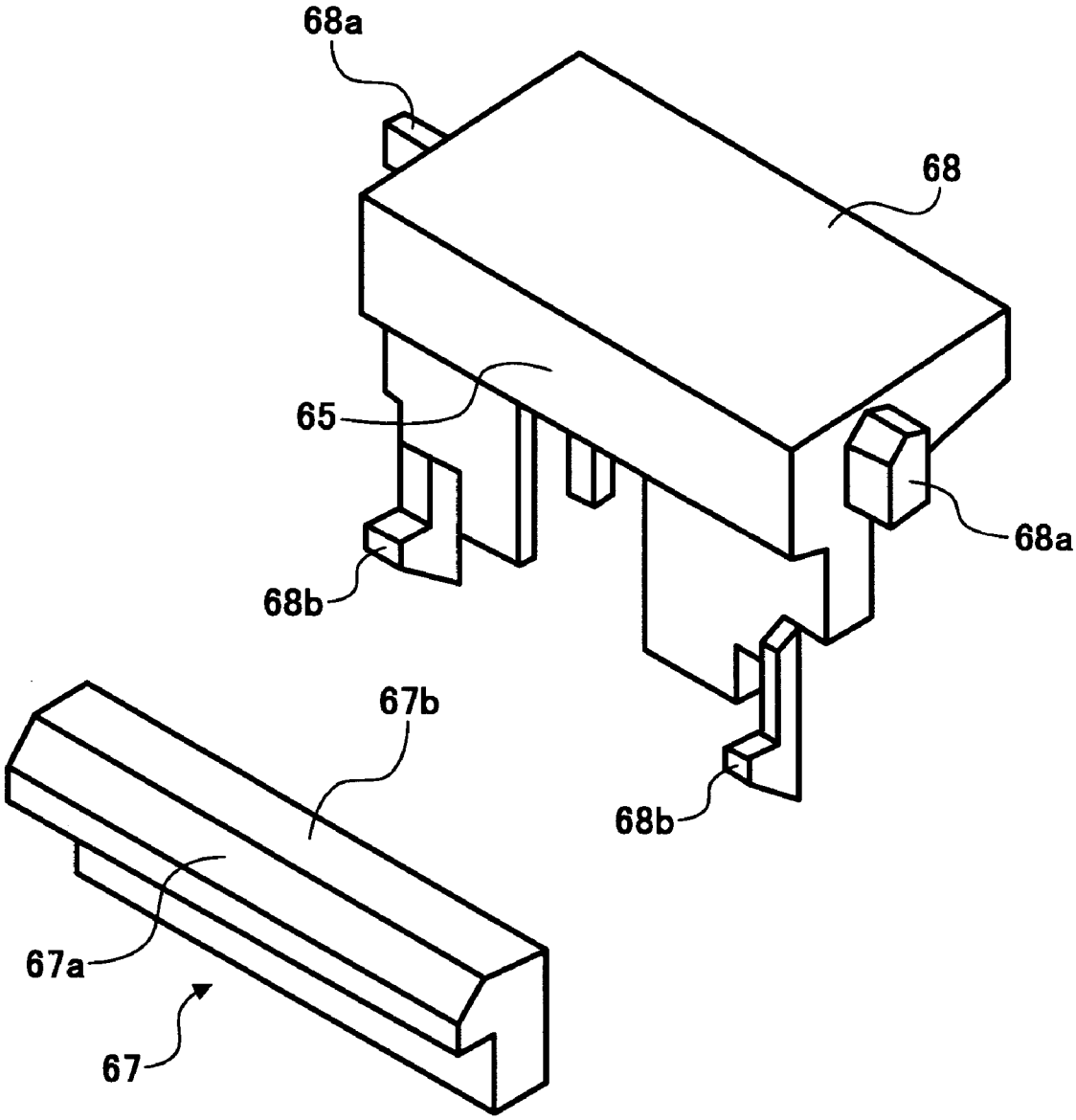
FIG. 8 is a diagram showing the internal construction of the large paper feed apparatus of FIG. 7.

In a duplex mode of operations (i.e., two-sided copying), the image forming process is the same as the simplex mode of operations. When a sensor 26 detects a sheet, however, the sensor 26 moves a both-sides divergence nail 6. After that, the sheet is conveyed to conveyance rollers 15*a* and 15*b*. The conveyance rollers 15*a* and 15*b* are connected to motor and the conveyance rollers 15*a* and 15*b* are rotated in reverse. Then, conveyance roller 16 conveys the registration rollers 2, and an image is formed on the other side of the sheet As shown in FIGS. 7 and 8, the tilt member 66 of the second embodiment includes a tilt part 67 and a support part 68. The tilt part 67 includes a tilt face 67*a* where the sheet contacts the tilt part 67 and a contact face 67*b* contacting the sheet feed roller 54. The tilt part 67 is formed from a metal or other high durability material. For example, the tilt part 67 is formed from aluminum (Al), poly-ether-ether-ketone (PEEK), polyimide (PI), or an alloy that includes polyimide (PAI). The tilt member 66 also includes a support member 68 that may be formed of the same material as the tilt part 67 or may be formed from a lower-cost material, for example, ABS resin, polyacetal (POM), polybutylene terephthalate (PBT), or polycarbonate (PC). The tilt member 66 includes two ribs 68*a* in order for the tilt member 66 to be guided by guiding rails formed in a main body. Further, the tilt member 66 includes two hooks 68*b* for limiting the range of the movement of the tilt member 66.

Figure 9:
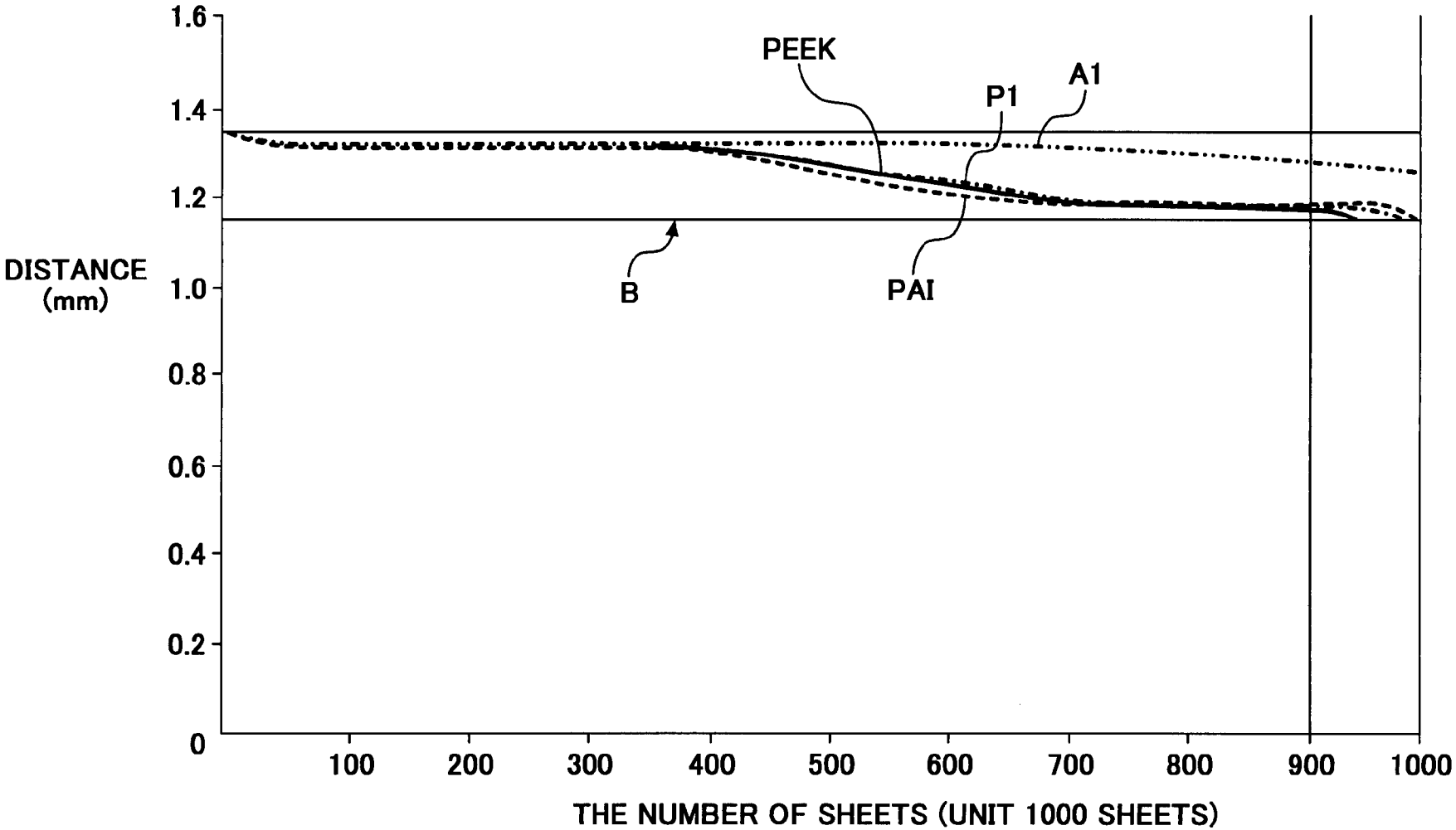
FIG. 9 is a chart of experiment results when different materials are used in the tilt member of FIG. 7.

FIG. 9 is chart of experimental results of different materials used in the large sheet feed apparatus of FIG. 6. In these experiments, conditions were similar to the conditions of the previous experiment except that the tilt member is now formed from one of aluminum (Al), poly-ether-ether-ketone (PEEK), polyimide (PI), or an alloy that includes polyimide (PAI). In FIG. 9, the line B is the empirically determined non-feed line corresponding to 0.2 mm wear from the initial thickness.

These experiments showed that a tilt member formed from the above-listed material has excellent wear resistance because the tilt member doesn't fall bellow the non-feed line until about 1,000,000 sheets. Therefore, these experiments show that the second embodiment has better wear resistant than the first embodiment and may be more cost-effective for use in tilt members in high-duty cycle, large sheet feed apparatus.

In other embodiments demonstrating excellent wear resistance, a glass fiber or another material can be added to the PBT, PE, Metal, PEEK, or PI. In yet other embodiments, alloys that include PBT, PE, Metal, PEEK, or PI can also be used.

It will be obvious to those having skill in the art that many changes may be made in the above-described details of the preferred embodiments of the present invention. The scope of the present invention, therefore, should be determined by the following claims.

What is claimed:

1. An image forming apparatus, comprising:

an image forming section; and a sheet feed apparatus aligned to feed a sheet to the image forming section and comprising a sheet feed roller configured to be in pressing contact with an uppermost sheet of a plurality of sheets, and a tilt member opposing the sheet feed roller, said tilt member including a tilt member contact body including a contact face in direct contact with the sheet feed roller, a tilt face configured to be in contact with an edge of the uppermost sheet, a back face, a bottom face, and a front face, the contact face extending from the back face to the tilt face, the tilt face extending from the contact face to the front face, the back face extending from the contact face to the bottom face, the back face being directly connected to the contact face, and the tilt member contact body is made of a first material consisting of one of aluminum (Al), poly-ether-ether-ketone (PEEK), polyimide (PI), and an alloy that contains polyimide (PAI); and a tilt member support body made of a second material different from the first material, said second material consisting of one of an ABS resin, polyacetal (POM), polybutylene terephthalate (PBT), and polycarbonate (PC), wherein said tilt member support body includes a support face and a top face that extends substantially perpendicular to the support face, and wherein the back face of said tilt member contact body directly contacts the support face of the tilt member support body.

2. The image forming apparatus according to claim 1, wherein said tilt member contact body is made of aluminum (Al).

3. The image forming apparatus according to claim 1, wherein said tilt member contact body is made of poly-ether-ether-ketone (PEEK).

4. The image forming apparatus according to claim 1, wherein said tilt member contact body is made of polyimide (PI).

5. The image forming apparatus according to claim 1, wherein said tilt member contact body is made of an alloy that contains polyimide (PAI).

6. The image forming apparatus according to claim 1, wherein said tilt member support body is made of an ABS resin.

7. The image forming apparatus according to claim 1, wherein said tilt member support body is made of polyacetal (POM).

8. The image forming apparatus according to claim 1, wherein said tilt member support body is made of polybutylene terephthalate (PBT).

9. The image forming apparatus according to claim 1, wherein said tilt member support body is made of polycarbonate (PC).

10. The image forming apparatus according to claim 1, wherein said tilt member support body includes two hooks that extend away from said tilt member support body in a direction that is substantially parallel to the support face.

11. The image forming apparatus according to claim 1, wherein said tilt member support body includes two ribs that each include a front face that extends substantially parallel to the support face.

12. The image forming apparatus according to claim 1, wherein the contact face of the tilt member contact body is substantially perpendicular to the back face of said tilt member contact body.

13. A sheet feeding apparatus, comprising:

a sheet feed roller configured to be in pressing contact with an uppermost sheet of a plurality of sheets, and a tilt member opposing the sheet feed roller, said tilt member including a tilt member contact body including a contact face in direct contact with the sheet feed roller, a tilt face configured to be in contact with an edge of the uppermost sheet, a back face, a bottom face, and a front face, the contact face extending from the back face to the tilt face, the tilt face extending from the contact face to the front face, the back face extending from the contact face to the bottom face, the back face being directly connected to the contact face, and the tilt member contact body is made of a first material consisting of one of aluminum (Al), poly-ether-ether-ketone (PEEK), polyimide (PI), and an alloy that contains polyimide (PAI); and a tilt member support body made of a second material different from the first material, said second material consisting of one of an ABS resin, polyacetal (POM), polybutylene terephthalate (PBT), and polycarbonate (PC), wherein said tilt member support body includes a support face and a top face that extends substantially perpendicular to the support face, and wherein the back face of said tilt member contact body directly contacts the support face of the tilt member support body.

14. The sheet feeding apparatus according to claim 13, wherein said tilt member support body includes two hooks that extend away from said tilt member support body in a direction that is substantially parallel to the support face.

15. The sheet feeding apparatus according to claim 13, wherein said tilt member support body includes two ribs that each include a front face that extends substantially parallel to the support face.

16. The sheet feeding apparatus according to claim 13, wherein the contact face of the tilt member contact body is substantially perpendicular to the back face of said tilt member contact body.

* * * * *